US012471667B2

(12) United States Patent
Greenhalgh et al.

(10) Patent No.: US 12,471,667 B2
(45) Date of Patent: Nov. 18, 2025

(54) ARTICLE OF FOOTWEAR HAVING A BOTTOM WITH DOME COMPONENT

(71) Applicant: Reebok International Limited, Altrincham (GB)

(72) Inventors: John S. Greenhalgh, Foxboro, MA (US); Thomas J. Piacentini, Waltham, MA (US); Kyung Lee, Newton, MA (US)

(73) Assignee: Reebok International Limited, Altrincham (GB)

( * ) Notice: Subject to any disclaimer, the term of this patent is extended or adjusted under 35 U.S.C. 154(b) by 0 days.

(21) Appl. No.: 17/830,870

(22) Filed: Jun. 2, 2022

(65) Prior Publication Data

US 2023/0389650 A1 Dec. 7, 2023

(51) Int. Cl.

| | |
|---|---|
| ***A43B 13/14*** | (2006.01) |
| ***A43B 13/04*** | (2006.01) |
| ***A43B 13/12*** | (2006.01) |

(52) U.S. Cl.

CPC ..... *A43B 13/146* (2013.01); *A43B 13/04* (2013.01); *A43B 13/125* (2013.01)

(58) Field of Classification Search

USPC ..... 36/88, 92

See application file for complete search history.

(56) References Cited

U.S. PATENT DOCUMENTS

| | | | | |
|---|---|---|---|---|
| 1,448,600 | A * | 3/1923 | Shortridge | A43B 13/34 36/69 |
| 6,401,366 | B2 * | 6/2002 | Foxen | A43B 7/1495 36/102 |
| 6,519,874 | B1 | 2/2003 | Dean | |
| 11,297,894 | B1 * | 4/2022 | Yang | A43B 7/149 |
| 2004/0111920 | A1 * | 6/2004 | Cretinon | A43B 13/141 36/30 R |
| 2004/0168350 | A1 * | 9/2004 | Mathieu | A43B 13/12 36/28 |
| 2005/0267775 | A1 * | 12/2005 | Willis | A43B 3/24 705/1.1 |
| 2006/0283047 | A1 * | 12/2006 | Schoenborn | A43B 13/206 36/28 |
| 2007/0033835 | A1 | 2/2007 | Bray | |
| 2007/0101617 | A1 * | 5/2007 | Brewer | A43B 7/08 36/103 |
| 2007/0256329 | A1 * | 11/2007 | Antonelli | A43B 5/02 36/68 |
| 2008/0244930 | A1 * | 10/2008 | Rivas | A43B 23/17 36/3 R |

(Continued)

FOREIGN PATENT DOCUMENTS

EP 1728446 A1 12/2006

*Primary Examiner* — Jameson D Collier
*Assistant Examiner* — Matthew R Marchewka
(74) *Attorney, Agent, or Firm* — STERNE, KESSLER, GOLDSTEIN & FOX P.L.L.C.

(57) ABSTRACT

An article of footwear includes an upper and a midsole coupled to the upper. The midsole includes a cavity formed in a heel portion of the midsole, and the cavity has an interior surface. The article of footwear includes a dome-shaped support member disposed within the cavity, and a foam insert disposed below the support member. A top surface of the dome-shaped support member abuts the interior surface of the cavity of the midsole.

16 Claims, 7 Drawing Sheets

(56) References Cited

U.S. PATENT DOCUMENTS

| | | | | |
|---|---|---|---|---|
| 2009/0188131 | A1* | 7/2009 | Doerer | A43B 7/1435 36/35 R |
| 2009/0260259 | A1* | 10/2009 | Berend | A43B 7/1435 36/35 B |
| 2010/0293816 | A1* | 11/2010 | Truelsen | A43B 13/141 36/30 R |
| 2011/0041365 | A1* | 2/2011 | Ludemann | A43B 17/02 36/3 R |
| 2011/0126422 | A1* | 6/2011 | Vattes | A43B 13/145 36/28 |
| 2011/0185592 | A1* | 8/2011 | Nishiwaki | A43B 23/17 36/69 |
| 2015/0143720 | A1* | 5/2015 | Avar | A43B 23/042 36/107 |
| 2015/0327624 | A1* | 11/2015 | Grott | A43B 13/184 36/91 |
| 2016/0353836 | A1* | 12/2016 | Luedecke | A43B 13/16 |
| 2017/0347747 | A1* | 12/2017 | Groeneweg | A43B 7/20 |

* cited by examiner

ARTICLE OF FOOTWEAR HAVING A BOTTOM WITH DOME COMPONENT

FIELD

The present disclosure relates to articles of footwear and methods of making articles of footwear. In particular, embodiments relate to an article of footwear having a sole with a support component.

BACKGROUND

Articles of footwear are used to enhance the wearer's walking and/or running experience. For example, a midsole may provide cushioning, support, and stability. Some articles of footwear are specifically designed for one specific athletic activities such as running, jumping, or weight lifting. As such, a shoe designed for running may not provide sufficient support for a weight lifter during a weight lifting activity. However, some activities, for example, cross-fit require athletes to run, jump, and weight lift, and traditionally designed shoes are insufficient for these types of activities. Improvements to soles and articles of footwear that contribute to these and other characteristics are desirable.

BRIEF SUMMARY

In some embodiments, an article of footwear includes an upper and a midsole coupled to the upper. In some embodiments, the midsole includes a cavity formed in a heel portion of the midsole. In some embodiments, the cavity has an interior surface and a dome-shaped support member is disposed within the cavity. In some embodiments, a foam insert is disposed below the support member. In some embodiments, a top surface of the dome-shaped support member abuts the interior surface of the cavity of the midsole.

In some embodiments, the article of footwear includes an outsole coupled to the midsole.

In some embodiments, the outsole covers the foam insert within the dome-shaped support member.

In some embodiments, the dome-shaped support member is symmetrical

In some embodiments, the dome-shaped support member is medially biased.

In some embodiments, the dome-shaped support member is composed of thermoplastic polyurethane.

In some embodiments, the midsole includes a plurality of arch-shaped support members disposed below the dome-shaped support members.

In some embodiments, the dome-shaped support member is disposed in the rear 40% of the midsole (e.g., in the rear 30% of the midsole).

In some embodiments, a wall thickness of the dome-shaped support member is asymmetrical.

In some embodiments, a wall of the dome-shaped support member has a variable thickness, and wherein the wall is thicker on a medial side of the support member.

In some embodiments, an article of footwear includes an upper, a midsole coupled to the upper, and an outsole coupled to the midsole. In some embodiments, the midsole includes one or more cavities, a heel clip disposed within one or more of the cavities, and a foam insert disposed below the heel clip. In some embodiments, the cavities are formed in the heel portion of the midsole and/or along the midfoot.

In some embodiments, the heel clip is exposed on an exterior of the midsole.

In some embodiments, the heel clip includes one or more support members disposed in the heel portion of the midsole.

In some embodiments, a method of manufacturing an article of footwear includes forming a midsole, wherein the midsole includes a cavity in a heel portion of the midsole, inserting a dome-shaped support member within the cavity, injecting foam in-between the dome-shaped support member and the midsole, and securing an upper to the midsole.

BRIEF DESCRIPTION OF THE FIGURES

The accompanying drawings, which are incorporated herein and form part of the specification, illustrate embodiments and, together with the description, further serve to explain the principles of the embodiments and to enable a person skilled in the relevant art(s) to make and use the embodiments.

Figure 1:
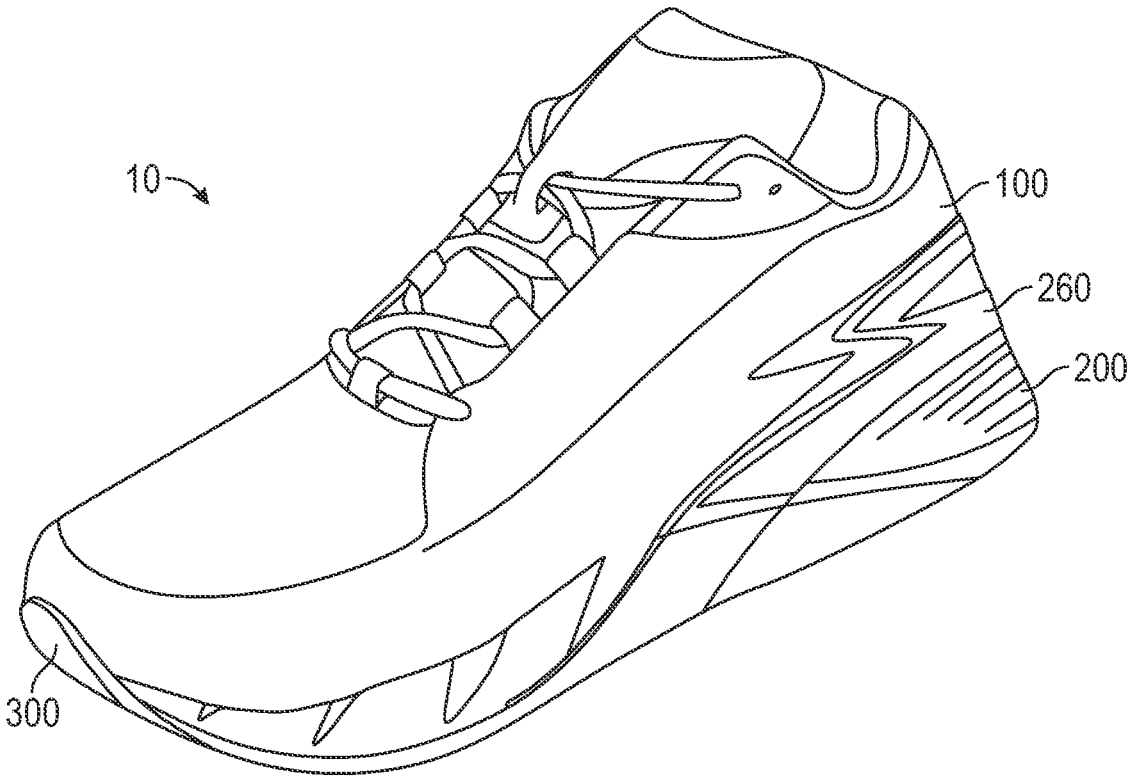
FIG. 1 is a perspective view of an article of footwear according to an embodiment.

The features and advantages of the embodiments will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "one embodiment," "an embodiment," "an exemplary embodiment," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The terms "about" or "substantially" or "approximately" as used herein refer to a considerable degree or extent. When used in conjunction with, for example, an event, circumstance, characteristic, or property, the term "about" or "substantially" or "approximately" can indicate a value of a given quantity that varies within, for example, 1-15% of the value (e.g., ±1%, ±2%, ±5%, ±10%, or ±15% of the value), such as accounting for typical tolerance levels or variability of the embodiments described herein.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Articles of footwear are used to enhance the wearer's walking, running, and/or lifting experience. For example, a midsole may provide cushioning, support, and stability. While some athletic footwear are designed for a specific activity such as running, weightlifting, or agility, the present disclosure teaches an athletic footwear that has the lightweight feel and flexibility of a running shoe and also provides vertical stability during activities such as training or weightlifting. The article of footwear of the present disclosure includes a dome-shaped support member disposed in the heel of the article of footwear, and may provide the desired level of cushioning, support, and stability to the wearer across activities. For example, the dome-shaped support member may provide the vertical stability during training or weightlifting, while also allowing the sole of the article of footwear to sheer during activities such as running.

The disclosed embodiments provide articles of footwear having a midsole with a dome-shaped support member. The dome-shaped support member contributes to an optimal level of cushioning and maximized support by enhancing the ability of the midsole to collapse during physical activities such as running, while preventing the midsole to collapse under vertical loads such as weightlifting. The midsole may also be configured in a way that facilitates sheering during running. Thus, the article of footwear may provide stability to lift more weight without sacrificing comfort during activities such as running.

In some embodiments, the midsole defines one or more cavities for housing a support member. In some embodiments, a cavity is formed in a heel portion of the midsole and houses a dome-shaped support member. The geometric shape of the support member allows for the resistance to vertical loads (e.g. during weightlifting), while still promoting the sheering or collapsing of the midsole during activities such as running. The amount of vertical resistance provided by the support member is determined based on the material, thickness, and height of the support member. For example, the more rigid the selected material, the greater the thickness of the material, and the smaller the height, the support member will resist a greater amount of vertical forces.

In some embodiments, an article of footwear 10, as shown, for example, in FIG. 1, comprises an upper 100, a midsole 200 coupled to upper 100, and in some embodiments, an outsole 300 coupled to midsole 200. Any suitable upper may be used as upper 100. In some embodiments, upper 100 may be made of woven single-layer or multi-layer portions, or other suitable materials. In some embodiments, upper 100 may be a knit material. Upper 100 may include a tongue and laces or may be tongueless. Other fastening systems besides shoelaces may be used. Although these examples are given, any other upper may also be used.

Upper 100 may be attached to midsole 200. In some embodiments, upper 100 may be stitched, bonded, or adhered to midsole 200. In some embodiments, midsole 200 is coupled to outsole 300. For example, midsole 200 may be directly bonded to outsole 300.

Midsole 200 provides support and cushioning to article of footwear 10. In some embodiments, midsole 200 comprises foam. For example, midsole 200 may comprise ethylene-vinyl acetate (EVA), expanded thermoplastic polyurethane particle foam (e-TPU), other suitable foams, and/or combinations thereof. In some embodiments, midsole 200 may be made of a combination of different materials (e.g., e-TPU particle foam and EVA foam).

Figure 2:
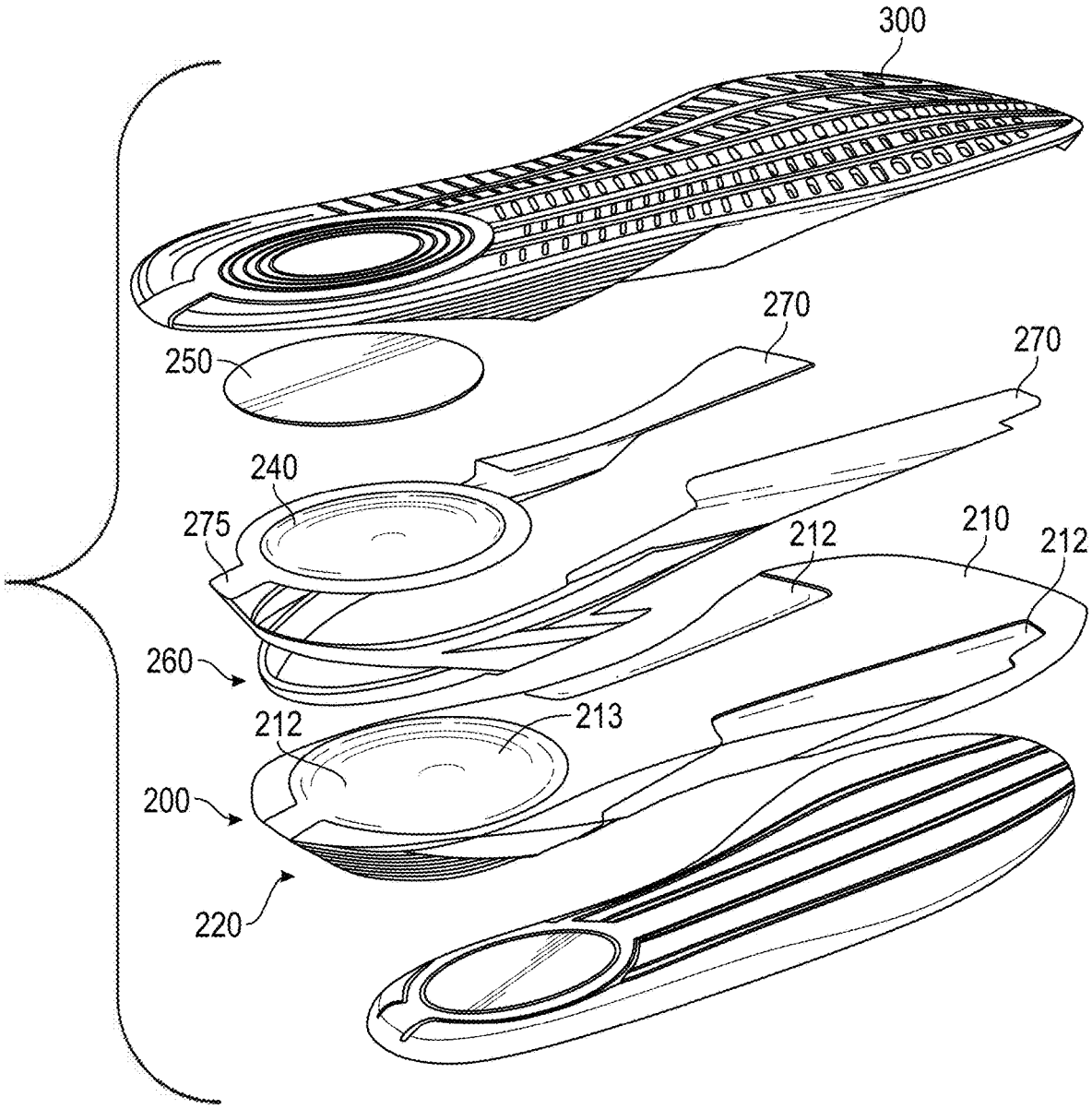
FIG. 2 is an exploded view of a midsole according to an embodiment.
Figure 4:
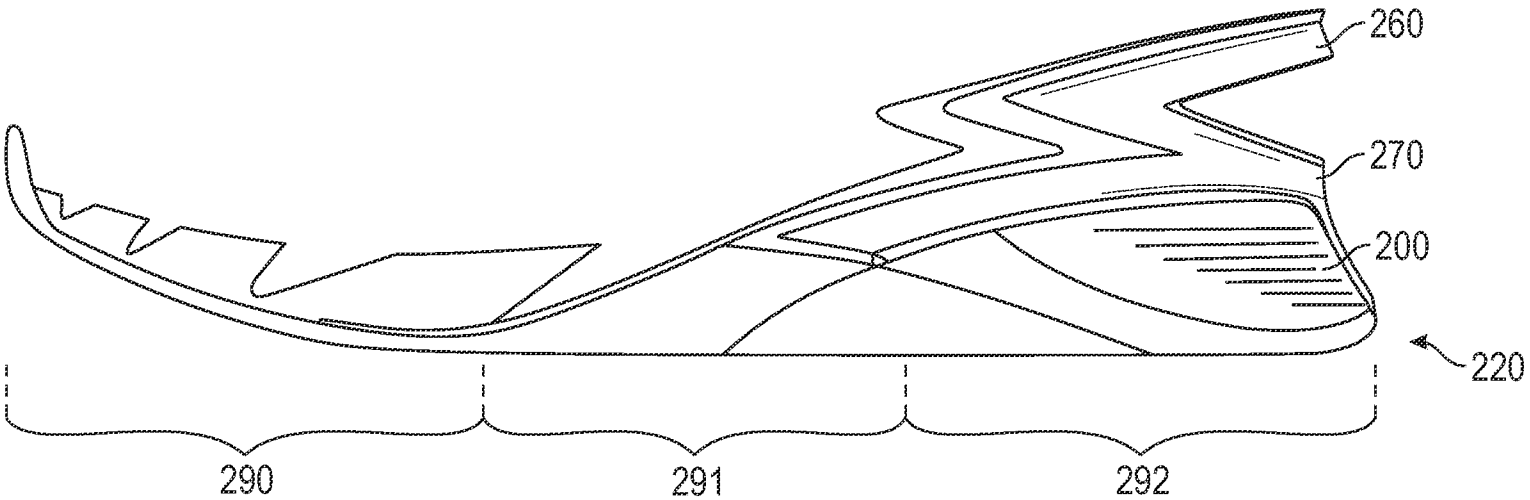
FIG. 4 is a side view of midsole according to an embodiment.
Figure 9:
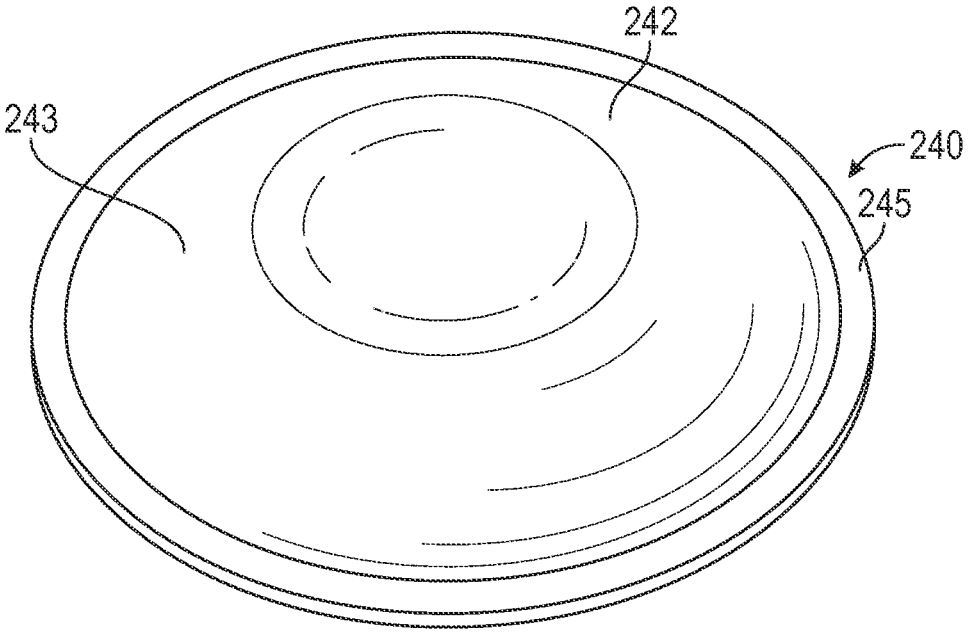
FIG. 9 is a perspective view of a midsole support component according to an embodiment.

As shown in FIG. 2, midsole 200 defines a bottom surface 210 having one or more cavities 212. Cavities 212 have an interior surface 213. In some embodiments, cavities 212 are disposed in a heel portion 292 (see, e.g., FIG. 4). In some embodiments, cavities 212 are disposed in a midfoot portion 291. In some embodiments, midsole 200 includes a support member 240 disposed within cavities 212. Where midsole 200 has more than one cavity 212, a support member 240 may be disposed in some or all of cavities 212. In some embodiments, a top surface 242 (see FIG. 9) of support member 240 abuts interior surface 213 of cavity 212. In some embodiments, support member 240 may be attached to interior surface 213 of cavity 212. For example, top surface 242 of support member 240 may be glued, bonded, or molded to interior surface 213 of cavity 212 or another portion of midsole 200.

Figure 10:
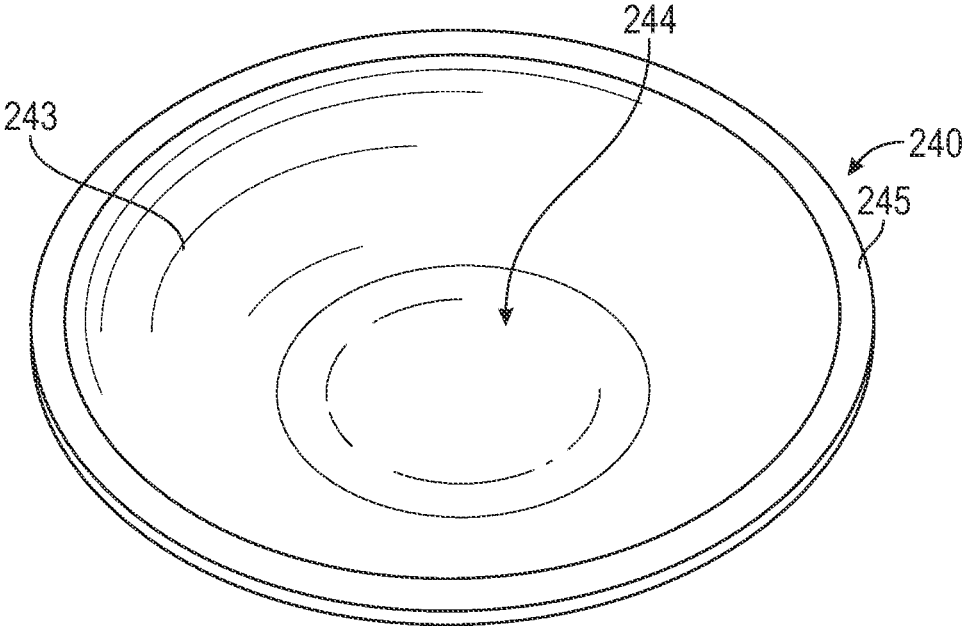
FIG. 10 is a perspective view of a midsole support component according to an embodiment.
Figure 11:
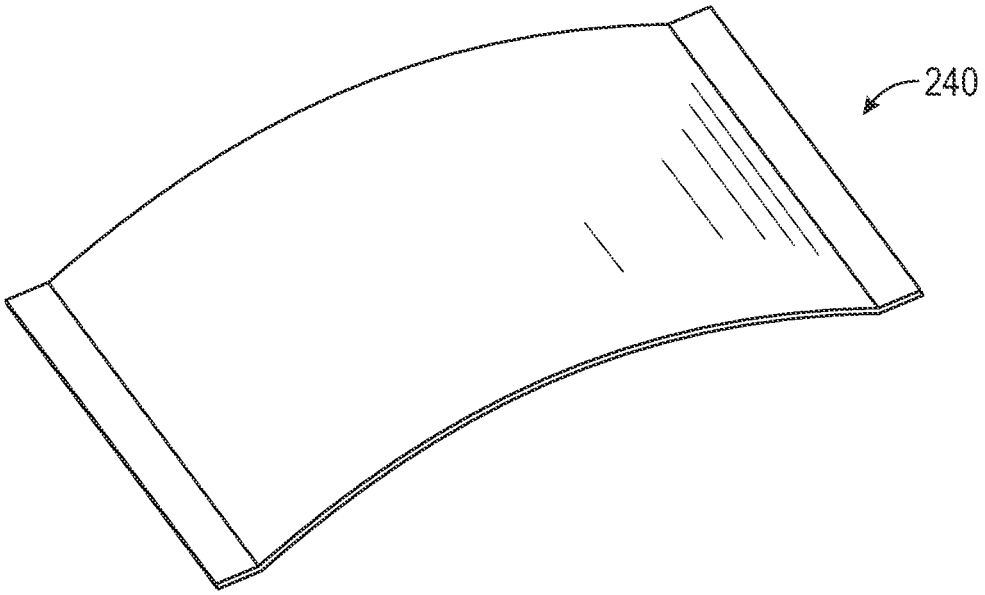
FIG. 11 is a perspective view of a midsole support according to an embodiment.

In some embodiments, the support member 240 has a dome-shape. The dome-shaped support member 240 may include a semi-hemispherical wall 243 defining an open space 244 below the wall, as shown, for example, in FIG. 10. In some embodiments, an annular flange 245 may be provided at the base of wall 243. In some embodiments, annular flange 245 may facilitate attachment of the support member 240 to midsole 200 or other component of article of footwear 10. In some embodiments, as shown for example in FIG. 11, support member 240 is shaped as an arch. In some embodiments, support member 240 is shaped as an array of arches. In some embodiments, midsole 200 has a plurality of support members 240 disposed in the cavities 212.

Support members 240 may be configured to distribute forces during activities such as lifting, without compromising the comfort of the article of footwear during activities such as running. For example, a dome-shaped support member 240 receives vertical force loads from a user's heel during activities such as lifting. The geometry of dome-shaped support member 240 allows the vertical load to be resisted without allowing midsole 200 to collapse. However, the geometry of dome-shaped support member 240 allows midsole 300 to sheer and collapse during activities such as running, which helps to promote the comfort of article of footwear 10. The forces applied at an angle (i.e. non-vertical forces) during activities, such as running, are not resisted by support member 240, or are less resisted by support member 240, and instead allow the midsole to sheer and collapse, providing a comfortable running experience to the user without sacrificing the stability during weightlifting. The geometric shape and design of support member 240 allows for increased comfort and support to a user during all kinds of activities such as lifting and running.

In some embodiments, support member 240 is symmetrical. In this manner, the overall shape of support member 240 is symmetrical about a center axis of support member 240. In this manner, the thickness of support member wall 243 may also be consistent. In some embodiments, support member 240 is disposed in heel portion 220. In some embodiments, support member 240 is disposed in the rear 40% of midsole 200 (e.g., in the rear 30% as shown in FIG.

Figure 5:
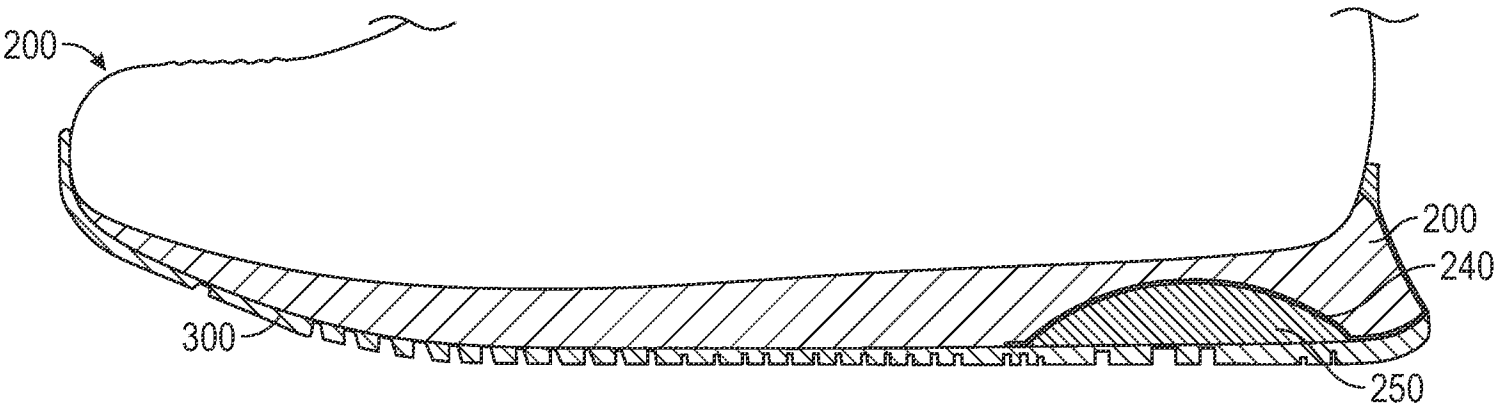
FIG. 5 is a cross-sectional view of an article of footwear according to an embodiment.
Figure 6:
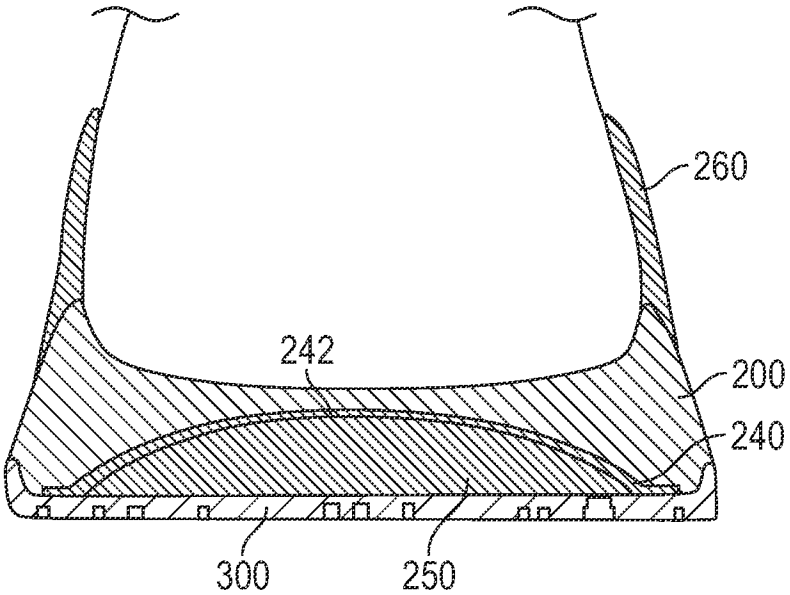
FIG. 6 is a cross-sectional view of an article of footwear according to an embodiment.

5). As shown in FIG. 5, in some embodiments support member 240 may extend over a majority of heel portion 220. For example, support member 240 may extend 20-35% of the length of midsole 200 (e.g., positioned within the rear 40% of midsole 200) and 60-100% (e.g., 70-90%) of the maximum width of midsole 200 at its position (see FIG. 6). As shown in cross-sectional view of FIG. 6, support member 240 has a height less than the height of midsole 200. In some embodiments, support member 240 has a width less than the width of midsole 200.

In some embodiments, support member 240 is medially biased to accommodate overpronation in a user's gait. In some embodiments, support member 240 is laterally biased to accommodate underpronation in a user's gait. For example, wall 243 of support member 240 may have a greater thickness on the medial or lateral side to provide additional support and to help resist overpronation or underpronation. In some embodiments, an entire first half of support member wall 243 may be thicker than an entire second half of support member wall 243. In other embodiments, a portion smaller than half of the support member wall 243 may be thicker.

In some embodiments, a foam insert 250 is disposed within cavity 212 directly below support member 240. In some embodiments, foam insert 250 may comprise EVA foam, eTPU, other suitable foams, and/or combinations thereof.

In some embodiments, midsole 200 and foam insert 250 are disposed above and directly below support member 240 to provide additional comfort and support to a user. In some embodiments, midsole 200 and foam insert 250 together help to promote sheering in the forward direction such as during running, while also providing midsole 200 with a stiffer support member 240 during vertical movements (e.g. lifting).

Figure 7:
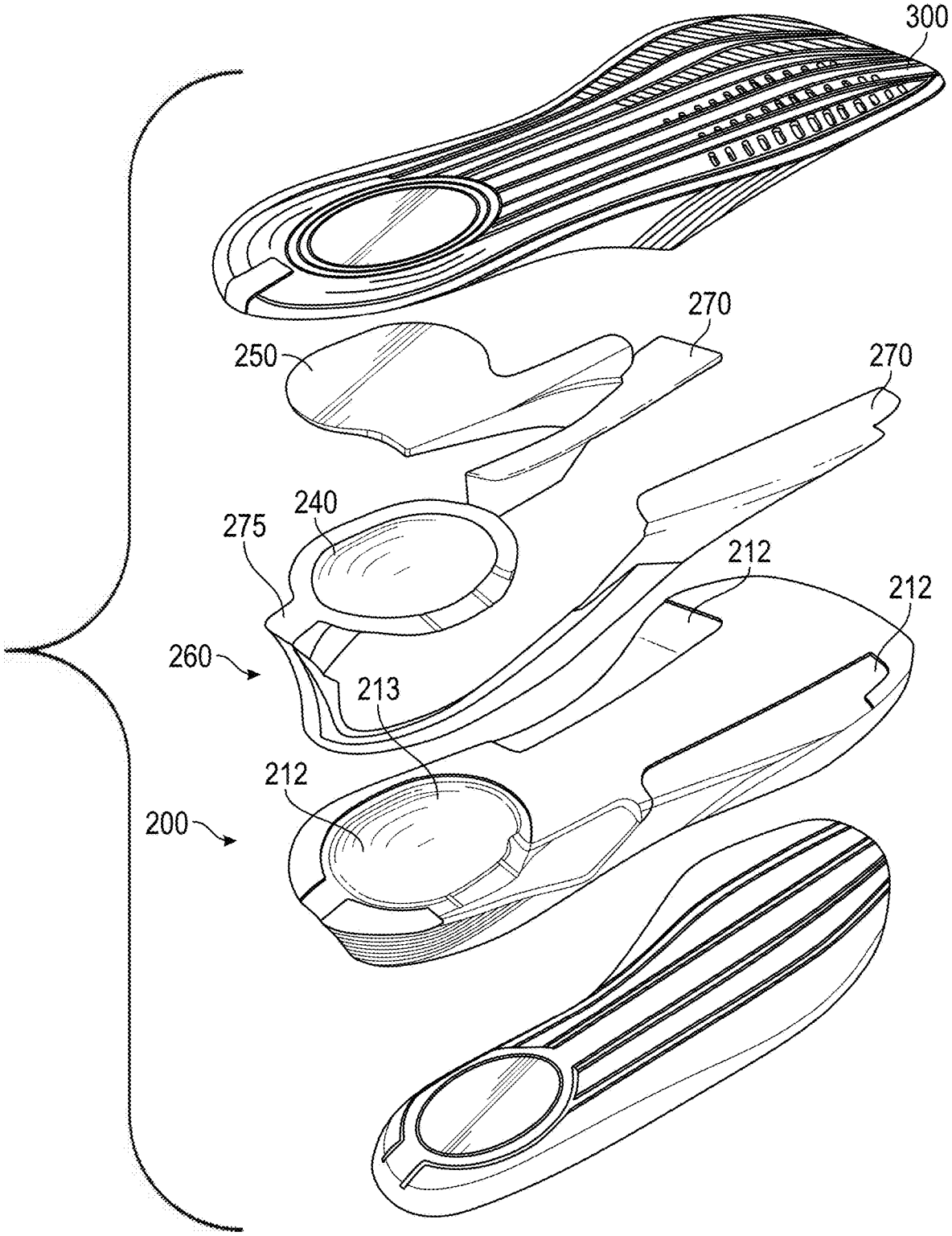
FIG. 7 is an exploded view of a midsole according to an embodiment.
Figure 8:
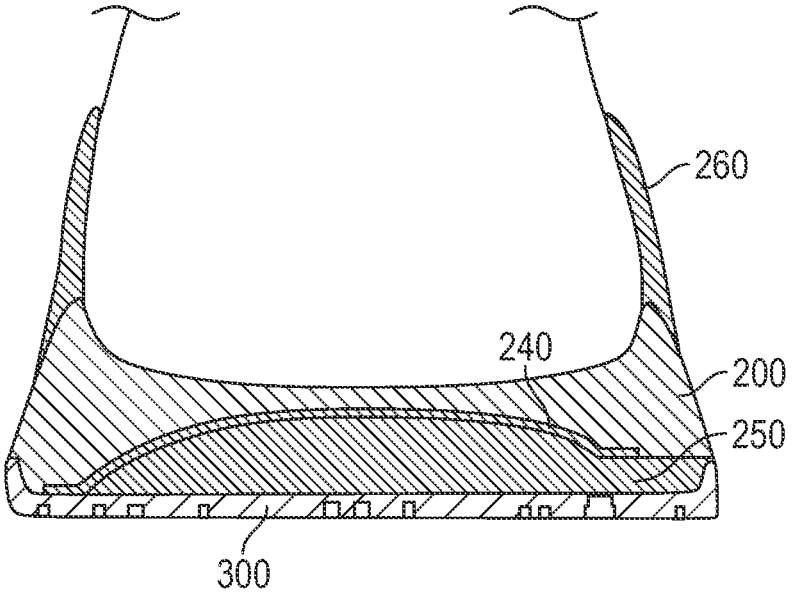
FIG. 8 is a cross-sectional view of a midsole according to an embodiment.

In some embodiments, foam insert 250 may conform to the shape of support member 240. For example, foam insert 250 may be dome-shaped or arch-shaped according to the shape of support member 240, and foam insert 250 may be symmetrical about the center axis of support member 240. In some embodiments, however, foam insert 250 be asymmetrical in order to accommodate overpronation or underpronation in a user's gait. For example, foam inset 250 may have extra foam component towards the lateral side of article of footwear 10, as shown in FIGS. 7 and 8, in order to help resist overpronation. In this case, flange 245 of support member 240 may be raised on one side to accommodate the extra foam component (see FIG. 8).

Figure 3:
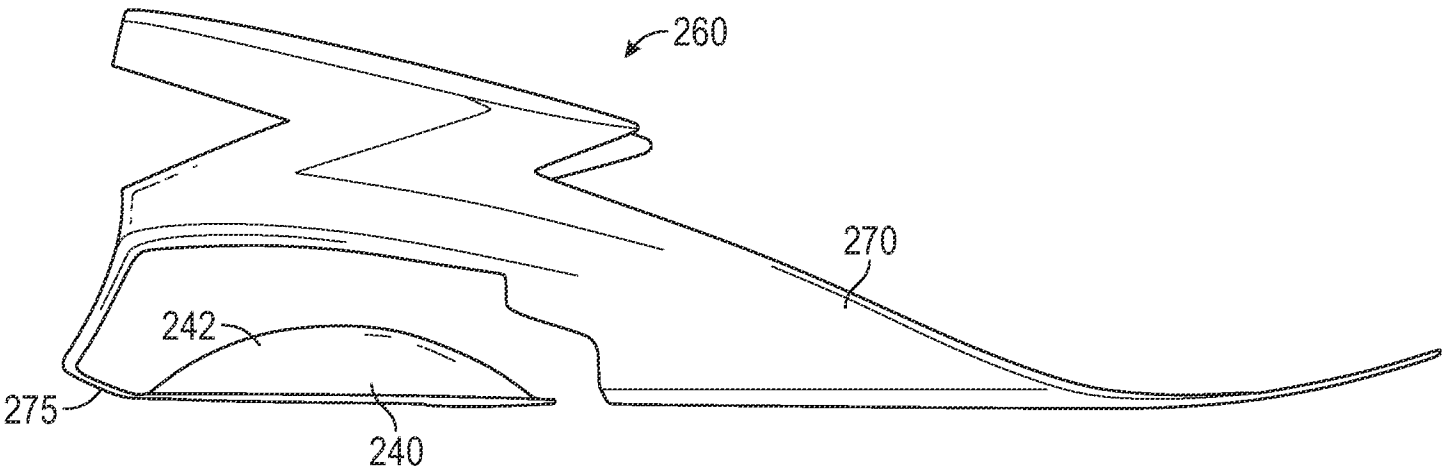
FIG. 3 is a side view of a heel clip according to an embodiment.

In some embodiments, midsole 200 includes a heel clip 260. As shown in FIG. 3, heel clip 260 includes one or more exterior supports 270. When assembled, exterior supports 270 are disposed within cavities 212 of midsole 200 (see FIG. 2) and exposed on an exterior of article of footwear 10 (see FIG. 4). Heel clip 260 provides lateral support to midsole 200. In some embodiments, heel clip 260 is made of thermoplastic polyurethane (TPU). In some embodiments, heel clip 260 is made of a bio-based material. In some embodiments, support member 240 and heel clip 260 are a single and unitary component to allow for easier manufacturing of article of footwear 10. In this manner, support member 240 and heel clip 260 may be molded as a unitary component. In some embodiments, heel clip 260 includes support connector 275 to couple heel clip 260 to support member 240. In some embodiments, support connector 275 is disposed at the rear of article of footwear 10. In some embodiments, support connector 275 is disposed at the medial side of article of footwear 10. In some embodiments, as shown for example in FIGS. 1 and 4, heel clip 260 extends around midsole 200 and upper 100. Heel clip 260 provides additional medial and lateral support to upper 100. For example, heel clip 260 may be made of a more rigid material than upper 100, thus allowing upper 100 to remain lightweight, while also providing stability to a user during athletic activities.

In some embodiments, as shown for example in FIG. 1, article of footwear 10 includes outsole 300. Outsole 300 is disposed on bottom surface 210 of midsole 200. In some embodiments, outsole 300 extends across entire bottom surface 210 of midsole 200. In some embodiments, outsole 300 extends across bottom surface 210 of midsole 200 such that support member 240 is covered by outsole 300. In some embodiments, outsole 300 may cover only portions of support member 240. Outsole 300 may be disposed in some or all portions of midsole 200.

In some embodiments, outsole 300 is composed of one piece (as shown in FIG. 2). In some embodiments, outsole 300 is composed of multiple pieces. In some embodiments, outsole 300 may be selectively disposed such that it covers only the portions of the midsole 200 that would undergo the most forces during physical activity, such as a forefoot portion 290, midfoot portion 291, and heel portion 292. Within each portion, outsole 300 may be even further selectively disposed such that it covers the most commonly worn areas within each portion for a specific type of runner. For runners who overpronate during running, the outsole 300 may be disposed on the medial side of the each portion. For runners who underpronate during running, outsole 300 may be disposed on the lateral area of each portion. And, for runners who have a neutral running gait, outsole 300 may be disposed within the center of each portion.

In some embodiments, outsole 300 seals foam insert 250 within open space 244 of support member 240. In some embodiments, article of footwear 10 does not include an outsole 300.

In some embodiments, midsole 200 may be manufactured by EVA injection molding. In some embodiments, midsole 200 is molded with one or more cavities 212. In some embodiments, support member 240 is inserted within cavities 212 and foam insert 250 is injected within open space 244 of support member 240. In some embodiments, foam insert 250 is separately molded and inserted within open space 244 of support member 240. Upper 100 may be manufactured separately from midsole 200 and coupled to midsole 200. In some embodiments, heel clip 260 is inserted within cavities 212 and coupled to midsole 200 and to upper 100. In some embodiments, outsole 300 is attached to bottom surface 210 of midsole 200.

It is to be appreciated that the Detailed Description section, and not the Summary and Abstract sections, is intended to be used to interpret the claims. The Summary and Abstract sections can set forth one or more but not all exemplary embodiments of the present embodiments as contemplated by the inventor(s), and thus, are not intended to limit the present embodiments and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the embodiments that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. An article of footwear comprising:

an upper;

a midsole coupled to the upper, wherein a bottom surface of the midsole comprises a first cavity formed in a heel portion of the midsole and a second cavity formed in a midfoot portion of the midsole, the first cavity having an interior surface;

a dome-shaped support member disposed within the first cavity of the midsole, wherein the dome-shaped support member comprises a semi-hemispherical wall with an annular flange;

a foam insert disposed below the dome-shaped support member and conforming to the shape of the dome-shaped support member, wherein a top surface of the dome-shaped support member abuts the interior surface of the first cavity of the midsole;

an exterior support coupled to the dome-shaped support member and disposed within the second cavity, wherein the exterior support is exposed on an exterior of the midsole; and a heel clip coupled to the dome-shaped support member through a support connector extending from a rearmost point of the dome-shaped support member and coupled to the exterior support.

2. The article of footwear of claim 1, further comprising an outsole coupled to the midsole.

3. The article of footwear of claim 2, wherein the outsole covers the foam insert disposed below the dome-shaped support member.

4. The article of footwear of claim 1, wherein the dome-shaped support member is symmetrical about a center axis of the dome-shaped support member.

5. The article of footwear of claim 1, wherein a wall thickness of the dome-shaped support member is asymmetrical about a center axis of the dome-shaped support member.

6. The article of footwear of claim 1, wherein a wall of the dome-shaped support member has a variable thickness, and wherein the wall is thicker on a medial side of the support member.

7. The article of footwear of claim 1, wherein the dome-shaped support member is composed of thermoplastic polyurethane.

8. The article of footwear of claim 1, wherein the dome-shaped support member is disposed in the rearmost 40% of the midsole.

9. The article of footwear of claim 1, wherein the dome-shaped support member is attached to the interior surface of the first cavity.

10. The article of footwear of claim 1, wherein the dome-shaped support member extends 60% to 100% of the maximum width of the midsole.

11. The article of footwear of claim 1, wherein the thickness of the dome-shaped support member is consistent.

12. The article of footwear of claim 1, wherein the exterior support, the dome-shaped support member, and the support connector define a unitary component, such that the exterior support and the dome-shaped support member are connected only through the support connector.

13. The article of footwear of claim 1, wherein the dome-shaped support is connected to the support connector through the annular flange.

14. An article of footwear comprising:

an upper;

a midsole coupled to the upper, wherein a bottom surface of the midsole comprises a first cavity formed in a heel portion of the midsole and a second cavity formed in a midfoot portion of the midsole, the first cavity and the second cavity each having an interior surface;

an outsole coupled to the midsole;

a heel clip comprising:

a dome-shaped support member disposed within the first cavity; and an exterior support disposed within the second cavity, and a support connector extending from a rearmost point of the dome-shaped support member and coupled to the exterior support, wherein a portion of the heel clip extends above a top surface of the dome-shaped support member; and a foam insert disposed below the heel clip.

15. The article of footwear of claim 14, wherein the heel clip is exposed on an exterior of the midsole.

16. The article of footwear of claim 14, wherein the exterior support is exposed on an exterior of the article of footwear.

* * * * *